US010657977B2

(12) United States Patent
Liu et al.

(10) Patent No.: US 10,657,977 B2
(45) Date of Patent: May 19, 2020

(54) METHOD FOR PROCESSING SPEECH/AUDIO SIGNAL AND APPARATUS

(71) Applicant: HUAWEI TECHNOLOGIES CO.,LTD., Shenzhen, Guangdong (CN)

(72) Inventors: Zexin Liu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/985,281

(22) Filed: May 21, 2018

(65) Prior Publication Data

US 2018/0268830 A1 Sep. 20, 2018

Related U.S. Application Data

(63) Continuation of application No. 15/369,396, filed on Dec. 5, 2016, now Pat. No. 9,978,383, which is a (Continued)

(30) Foreign Application Priority Data

Jun. 3, 2014 (CN) ..... 2014 1 0242233

(51) Int. Cl.
*G10L 19/00* (2013.01)
*G10L 19/028* (2013.01)
(Continued)

(52) U.S. Cl.
CPC ..... *G10L 19/028* (2013.01); *G10L 19/167* (2013.01); *G10L 19/26* (2013.01);
(Continued)

(58) Field of Classification Search
CPC ..... G10L 21/00; G10L 21/02; G10L 21/0316; G10L 21/034; G10L 21/0364;
(Continued)

(56) References Cited

U.S. PATENT DOCUMENTS 7,536,298 B2 5/2009 Ramkummar et al.
7,610,197 B2 10/2009 Cruz-Zeno et al.
(Continued)

FOREIGN PATENT DOCUMENTS

CN 101320563 A 12/2008
CN 101335003 A 12/2008
(Continued)

OTHER PUBLICATIONS

ETSI TS 126 445 V12.0.0 (Nov. 2014), Universal Mobile Telecommunications System (UMTS); LTE; EVS Codec Detailed Algorithmic Description(3GPP TS 26.445 version 12.0.0 Release 12) , 627 pages.

*Primary Examiner* — Qi Han
(74) *Attorney, Agent, or Firm* — Paul Christopher Hashim

(57) ABSTRACT

Method and apparatus are provided for reconstructing a noise component of a speech/audio signal. A bitstream, is received and decoded to obtain a speech/audio signal. A first speech/audio signal is determined according to the speech/audio signal. A symbol of each sample value in the first speech/audio signal and an amplitude value of each sample value in the first speech/audio signal is determined. An adaptive normalization length and an adjusted amplitude value of each sample value are determined according to the adaptive normalization length and the amplitude value of each sample value. A second speech/audio signal is determined according to the symbol of each sample value and the adjusted amplitude value of each sample value.

27 Claims, 4 Drawing Sheets

Related U.S. Application Data continuation of application No. PCT/CN2015/071017, filed on Jan. 19, 2015.

(51) Int. Cl.

| | |
|---|---|
| ***G10L 19/26*** | (2013.01) |
| ***G10L 21/02*** | (2013.01) |
| ***G10L 19/16*** | (2013.01) |
| ***G10L 21/0316*** | (2013.01) |
| *G10L 21/038* | (2013.01) |

(52) U.S. Cl.

CPC ..... *G10L 21/02* (2013.01); *G10L 21/0316* (2013.01); *G10L 21/038* (2013.01)

(58) Field of Classification Search

CPC ..... G10L 21/06; G10L 25/00; G10L 25/18; G10L 25/21; G10L 25/24; G10L 25/48; G10L 19/00; G10L 19/002; G10L 19/012; G10L 19/02; G10L 19/0204; G10L 19/0208; G10L 19/022; G10L 19/025; G10L 19/028; G10L 19/03; G10L 19/06; G10L 19/167; G10L 19/22; G10L 19/2426; G10L 19/265

USPC ..... 704/205, 206, 226, 200, 200.1, 500, 501

See application file for complete search history.

(56) References Cited

U.S. PATENT DOCUMENTS

| | | | |
|---|---|---|---|
| 8,139,777 | B2 | 3/2012 | Li et al. |
| 9,236,057 | B2 | 1/2016 | Kim et al. |
| 2001/0008975 | A1 | 7/2001 | Dobak et al. |
| 2001/0008995 | A1 | 7/2001 | Kim et al. |
| 2002/0120439 | A1 | 8/2002 | Mekuria et al. |
| 2005/0108007 | A1 | 5/2005 | Bessette et al. |
| 2006/0271359 | A1 | 11/2006 | Khalil et al. |
| 2007/0050189 | A1 | 3/2007 | Cruz-Zeno et al. |
| 2009/0326960 | A1 | 12/2009 | Breebaat et al. |
| 2010/0191522 | A1 | 7/2010 | Zhang et al. |
| 2011/0015923 | A1 | 1/2011 | Dai et al. |
| 2011/0173009 | A1 | 7/2011 | Fuchs et al. |
| 2012/0016667 | A1 | 1/2012 | Gao |
| 2013/0006644 | A1 | 1/2013 | Jiang et al. |
| 2013/0006645 | A1 | 1/2013 | Jiang et al. |
| 2013/0018660 | A1 | 1/2013 | Qi et al. |
| 2013/0066640 | A1 | 3/2013 | Grill et al. |
| 2013/0121508 | A1 | 5/2013 | Vaillancourt et al. |
| 2013/0132100 | A1 | 5/2013 | Sung et al. |
| 2013/0226595 | A1 | 8/2013 | Liu et al. |
| 2014/0044192 | A1 | 2/2014 | Liu et al. |

FOREIGN PATENT DOCUMENTS

| | | | |
|---|---|---|---|
| CN | 101366077 | A | 2/2009 |
| CN | 101483042 | A | 7/2009 |
| CN | 101483048 | A | 7/2009 |
| EP | 1895513 | A1 | 3/2008 |
| JP | 2013015598 | A | 1/2013 |
| JP | 2013531281 | A | 8/2013 |
| RU | 2460155 | C2 | 8/2012 |
| RU | 2483364 | C2 | 5/2013 |
| RU | 2492530 | C2 | 9/2013 |
| WO | 2000025301 | A1 | 5/2000 |
| WO | 03042982 | A1 | 5/2003 |

METHOD FOR PROCESSING SPEECH/AUDIO SIGNAL AND APPARATUS

CROSS-REFERENCE TO RELATED APPLICATIONS

This application is a continuation of U.S. patent application Ser. No. 15/369,396, filed on Dec. 5, 2016, now U.S. Pat. No. 9,978,383, which is a continuation of International Application No. PCT/CN2015/071017, filed on Jan. 19, 2015, which claims priority to Chinese Patent Application No. 201410242233.2, filed on Jun. 3, 2014. All of the afore-mentioned patent applications are hereby incorporated by reference in their entireties.

TECHNICAL FIELD

The present invention relates to the communications field, and in particular, to methods and apparatus for processing a speech/audio signal.

BACKGROUND

At present, to achieve better auditory quality, when decoding coded information of a speech/audio signal, an electronic device reconstructs a noise component of a speech/audio signal obtained by means of decoding.

At present, an electronic device reconstructs a noise component of a speech/audio signal generally by adding a random noise signal to the speech/audio signal. Specifically, weighted addition is performed on the speech/audio signal and the random noise signal, to obtain a signal after the noise component of the speech/audio signal is reconstructed. The speech/audio signal may be a time-domain signal, a frequency-domain signal, or an excitation signal, or may be a low frequency signal, a high frequency signal, or the like.

However, it is found that, if the speech/audio signal is a signal having an onset or an offset, this method for reconstructing a noise component of a speech/audio signal results in that a signal obtained after the noise component of the speech/audio signal is reconstructed has an echo, thereby affecting auditory quality of the signal obtained after the noise component is reconstructed.

SUMMARY

Embodiments of the present invention provide methods and apparatus for processing a speech/audio signal, so that for a speech/audio signal having an onset or an offset, when a noise component of the speech/audio signal is reconstructed, a signal obtained after the noise component of the speech/audio signal is reconstructed does not have an echo, thereby improving auditory quality of the signal obtained after the noise component is reconstructed.

According to a first aspect, an embodiment of the present invention provides a method for processing a speech/audio signal, where the method includes:

receiving a bitstream, and decoding the bitstream, to obtain a speech/audio signal;

determining a first speech/audio signal according to the speech/audio signal, where the first speech/audio signal is a signal, whose noise component needs to be reconstructed, in the speech/audio signal;

determining a symbol of each sample value in the first speech/audio signal and an amplitude value of each sample value in the first speech/audio signal;

determining an adaptive normalization length;

determining an adjusted amplitude value of each sample value according to the adaptive normalization length and the amplitude value of each sample value; and determining a second speech/audio signal according to the symbol of each sample value and the adjusted amplitude value of each sample value, where the second speech/audio signal is a signal obtained after the noise component of the first speech/audio signal is reconstructed.

With reference to the first aspect, in a first possible implementation manner of the first aspect, the determining an adjusted amplitude value of each sample value according to the adaptive normalization length and the amplitude value of each sample value includes:

calculating, according to the amplitude value of each sample value and the adaptive normalization length, an average amplitude value corresponding to each sample value, and determining, according to the average amplitude value corresponding to each sample value, an amplitude disturbance value corresponding to each sample value; and calculating the adjusted amplitude value of each sample value according to the amplitude value of each sample value and according to the amplitude disturbance value corresponding to each sample value.

With reference to the first possible implementation manner of the first aspect, in a second possible implementation manner of the first aspect, the calculating, according to the amplitude value of each sample value and the adaptive normalization length, an average amplitude value corresponding to each sample value includes:

determining, for each sample value and according to the adaptive normalization length, a subband to which the sample value belongs; and calculating an average value of amplitude values of all sample values in the subband to which the sample value belongs, and using the average value obtained by means of calculation as the average amplitude value corresponding to the sample value.

With reference to the second possible implementation manner of the first aspect, in a third possible implementation manner of the first aspect, the determining, for each sample value and according to the adaptive normalization length, a subband to which the sample value belongs includes:

performing subband grouping on all sample values in a preset order according to the adaptive normalization length; and for each sample value, determining a subband including the sample value as the subband to which the sample value belongs; or for each sample value, determining a subband consisting of m sample values before the sample value, the sample value, and n sample values after the sample value as the subband to which the sample value belongs, where m and n depend on the adaptive normalization length, m is an integer not less than 0, and n is an integer not less than 0.

With reference to the first possible implementation manner of the first aspect, and/or the second possible implementation manner of the first aspect, and/or the third possible implementation manner of the first aspect, in a fourth possible implementation manner of the first aspect, the calculating the adjusted amplitude value of each sample value according to the amplitude value of each sample value and according to the amplitude disturbance value corresponding to each sample value includes:

subtracting the amplitude disturbance value corresponding to each sample value from the amplitude value of each sample value, to obtain a difference between the amplitude value of each sample value and the amplitude disturbance value corresponding to each sample value, and using the obtained difference as the adjusted amplitude value of each sample value.

With reference to the first aspect, and/or the first possible implementation manner of the first aspect, and/or the second possible implementation manner of the first aspect, and/or the third possible implementation manner of the first aspect, and/or the fourth possible implementation manner of the first aspect, in a fifth possible implementation manner of the first aspect, the determining an adaptive normalization length includes:

dividing a low frequency band signal in the speech/audio signal into N subbands, where N is a natural number;

calculating a peak-to-average ratio of each subband, and determining a quantity of subbands whose peak-to-average ratios are greater than a preset peak-to-average ratio threshold; and calculating the adaptive normalization length according to a signal type of a high frequency band signal in the speech/audio signal and the quantity of the subbands.

With reference to the fifth possible implementation manner of the first aspect, in a sixth possible implementation manner of the first aspect, the calculating the adaptive normalization length according to a signal type of a high frequency band signal in the speech/audio signal and the quantity of the subbands includes:

calculating the adaptive normalization length according to a formula $L=K+\alpha\times M$, where L is the adaptive normalization length; K is a numerical value corresponding to the signal type of the high frequency band signal in the speech/audio signal, and different signal types of high frequency band signals correspond to different numerical values K; M is the quantity of the subbands whose peak-to-average ratios are greater than the preset peak-to-average ratio threshold; and $\alpha$ is a constant less than 1.

With reference to the first aspect, and/or the first possible implementation manner of the first aspect, and/or the second possible implementation manner of the first aspect, and/or the third possible implementation manner of the first aspect, and/or the fourth possible implementation manner of the first aspect, in a seventh possible implementation manner of the first aspect, the determining an adaptive normalization length includes:

calculating a peak-to-average ratio of a low frequency band signal in the speech/audio signal and a peak-to-average ratio of a high frequency band signal in the speech/audio signal; and when an absolute value of a difference between the peak-to-average ratio of the low frequency band signal and the peak-to-average ratio of the high frequency band signal is less than a preset difference threshold, determining the adaptive normalization length as a preset first length value, or when an absolute value of a difference between the peak-to-average ratio of the low frequency band signal and the peak-to-average ratio of the high frequency band signal is not less than a preset difference threshold, determining the adaptive normalization length as a preset second length value, where the first length value is greater than the second length value; or calculating a peak-to-average ratio of a low frequency band signal in the speech/audio signal and a peak-to-average ratio of a high frequency band signal in the speech/audio signal; and when the peak-to-average ratio of the low frequency band signal is less than the peak-to-average ratio of the high frequency band signal, determining the adaptive normalization length as a preset first length value, or when the peak-to-average ratio of the low frequency band signal is not less than the peak-to-average ratio of the high frequency band signal, determining the adaptive normalization length as a preset second length value; or determining the adaptive normalization length according to a signal type of a high frequency band signal in the speech/audio signal, where different signal types of high frequency band signals correspond to different adaptive normalization lengths.

With reference to the first aspect, and/or the first possible implementation manner of the first aspect, and/or the second possible implementation manner of the first aspect, and/or the third possible implementation manner of the first aspect, and/or the fourth possible implementation manner of the first aspect, and/or the fifth possible implementation manner of the first aspect, and/or the sixth possible implementation manner of the first aspect, and/or the seventh possible implementation manner of the first aspect, in an eighth possible implementation manner of the first aspect, the determining a second speech/audio signal according to the symbol of each sample value and the adjusted amplitude value of each sample value includes:

determining a new value of each sample value according to the symbol and the adjusted amplitude value of each sample value, to obtain the second speech/audio signal; or calculating a modification factor; performing modification processing on an adjusted amplitude value, which is greater than 0, in the adjusted amplitude values of the sample values according to the modification factor; and determining a new value of each sample value according to the symbol of each sample value and an adjusted amplitude value that is obtained after the modification processing, to obtain the second speech/audio signal.

With reference to the eighth possible implementation manner of the first aspect, in a ninth possible implementation manner of the first aspect, the calculating a modification factor includes:

calculating the modification factor by using a formula $\beta=a/L$, where $\beta$ is the modification factor, L is the adaptive normalization length, and a is a constant greater than 1.

With reference to the eighth possible implementation manner of the first aspect, and/or the ninth possible implementation manner of the first aspect, in a tenth possible implementation manner of the first aspect, the performing modification processing on an adjusted amplitude value, which is greater than 0, in the adjusted amplitude values of the sample values according to the modification factor includes:

performing modification processing on the adjusted amplitude value, which is greater than 0, in the adjusted amplitude values of the sample values by using the following formula:

$$Y=y\times(b-\beta);$$

where Y is the adjusted amplitude value obtained after the modification processing; y is the adjusted amplitude value, which is greater than 0, in the adjusted amplitude values of the sample values; and b is a constant, and $0<b<2$.

According to a second aspect, an embodiment of the present invention provides an apparatus for reconstructing a noise component of a speech/audio signal, including:

a bitstream processing unit, configured to receive a bitstream and decode the bitstream, to obtain a speech/audio signal;

a signal determining unit, configured to determine a first speech/audio signal according to the speech/audio signal obtained by the bitstream processing unit, where the first speech/audio signal is a signal, whose noise component needs to be reconstructed, in the speech/audio signal obtained by means of decoding;

a first determining unit, configured to determine a symbol of each sample value in the first speech/audio signal determined by the signal determining unit and an amplitude value of each sample value in the first speech/audio signal determined by the signal determining unit;

a second determining unit, configured to determine an adaptive normalization length;

a third determining unit, configured to determine an adjusted amplitude value of each sample value according to the adaptive normalization length determined by the second determining unit and the amplitude value that is of each sample value and is determined by the first determining unit; and a fourth determining unit, configured to determine a second speech/audio signal according to the symbol that is of each sample value and is determined by the first determining unit and the adjusted amplitude value that is of each sample value and is determined by the third determining unit, where the second speech/audio signal is a signal obtained after the noise component of the first speech/audio signal is reconstructed.

With reference to the second aspect, in a first possible implementation manner of the second aspect, the third determining unit includes:

a determining subunit, configured to calculate, according to the amplitude value of each sample value and the adaptive normalization length, an average amplitude value corresponding to each sample value, and determine, according to the average amplitude value corresponding to each sample value, an amplitude disturbance value corresponding to each sample value; and an adjusted amplitude value calculation unit, configured to calculate the adjusted amplitude value of each sample value according to the amplitude value of each sample value and according to the amplitude disturbance value corresponding to each sample value.

With reference to the first possible implementation manner of the second aspect, in a second possible implementation manner of the second aspect, the determining subunit includes:

a determining module, configured to determine, for each sample value and according to the adaptive normalization length, a subband to which the sample value belongs; and a calculation module, configured to calculate an average value of amplitude values of all sample values in the subband to which the sample value belongs, and use the average value obtained by means of calculation as the average amplitude value corresponding to the sample value.

With reference to the second possible implementation manner of the second aspect, in a third possible implementation manner of the second aspect, the determining module is configured to:

perform subband grouping on all sample values in a preset order according to the adaptive normalization length; and for each sample value, determine a subband including the sample value as the subband to which the sample value belongs; or for each sample value, determine a subband consisting of m sample values before the sample value, the sample value, and n sample values after the sample value as the subband to which the sample value belongs, where m and n depend on the adaptive normalization length, m is an integer not less than 0, and n is an integer not less than 0.

With reference to the first possible implementation manner of the second aspect, and/or the second possible implementation manner of the second aspect, and/or the third possible implementation manner of the second aspect, in a fourth possible implementation manner of the second aspect, the adjusted amplitude value calculation subunit is configured to:

subtract the amplitude disturbance value corresponding to each sample value from the amplitude value of each sample value, to obtain a difference between the amplitude value of each sample value and the amplitude disturbance value corresponding to each sample value, and use the obtained difference as the adjusted amplitude value of each sample value.

With reference to the second aspect, and/or the first possible implementation manner of the second aspect, and/or the second possible implementation manner of the second aspect, and/or the third possible implementation manner of the second aspect, and/or the fourth possible implementation manner of the second aspect, in a fifth possible implementation manner of the second aspect, the second determining unit includes:

a division subunit, configured to divide a low frequency band signal in the speech/audio signal into N subbands, where N is a natural number;

a quantity determining subunit, configured to calculate a peak-to-average ratio of each subband, and determine a quantity of subbands whose peak-to-average ratios are greater than a preset peak-to-average ratio threshold; and a length calculation subunit, configured to calculate the adaptive normalization length according to a signal type of a high frequency band signal in the speech/audio signal and the quantity of the subbands.

With reference to the fifth possible implementation manner of the second aspect, in a sixth possible implementation manner of the second aspect, the length calculation subunit is configured to:

calculate the adaptive normalization length according to a formula $L=K+\alpha\times M$, where L is the adaptive normalization length; K is a numerical value corresponding to the signal type of the high frequency band signal in the speech/audio signal, and different signal types of high frequency band signals correspond to different numerical values K; M is the quantity of the subbands whose peak-to-average ratios are greater than the preset peak-to-average ratio threshold; and $\alpha$ is a constant less than 1.

With reference to the second aspect, and/or the first possible implementation manner of the second aspect, and/or the second possible implementation manner of the second aspect, and/or the third possible implementation manner of the second aspect, and/or the fourth possible implementation manner of the second aspect, in a seventh possible implementation manner of the second aspect, the second determining unit is configured to:

calculate a peak-to-average ratio of a low frequency band signal in the speech/audio signal and a peak-to-average ratio of a high frequency band signal in the speech/audio signal; and when an absolute value of a difference between the peak-to-average ratio of the low frequency band signal and the peak-to-average ratio of the high frequency band signal is less than a preset difference threshold, determine the adaptive normalization length as a preset first length value, or when an absolute value of a difference between the peak-to-average ratio of the low frequency band signal and the peak-to-average ratio of the high frequency band signal is not less than a preset difference threshold, determine the adaptive normalization length as a preset second length value, where the first length value is greater than the second length value; or calculate a peak-to-average ratio of a low frequency band signal in the speech/audio signal and a peak-to-average ratio of a high frequency band signal in the speech/audio signal; and when the peak-to-average ratio of the low frequency band signal is less than the peak-to-average ratio of the high frequency band signal, determine the adaptive normalization length as a preset first length value, or when the peak-to-average ratio of the low frequency band signal is not less than the peak-to-average ratio of the high frequency band signal, determine the adaptive normalization length as a preset second length value; or determine the adaptive normalization length according to a signal type of a high frequency band signal in the speech/audio signal, where different signal types of high frequency band signals correspond to different adaptive normalization lengths.

With reference to the second aspect, and/or the first possible implementation manner of the second aspect, and/or the second possible implementation manner of the second aspect, and/or the third possible implementation manner of the second aspect, and/or the fourth possible implementation manner of the second aspect, and/or the fifth possible implementation manner of the second aspect, and/or the sixth possible implementation manner of the second aspect, and/or the seventh possible implementation manner of the second aspect, in an eighth possible implementation manner of the second aspect, the fourth determining unit is configured to:

determine a new value of each sample value according to the symbol and the adjusted amplitude value of each sample value, to obtain the second speech/audio signal; or calculate a modification factor; perform modification processing on an adjusted amplitude value, which is greater than 0, in the adjusted amplitude values of the sample values according to the modification factor; and determine a new value of each sample value according to the symbol of each sample value and an adjusted amplitude value that is obtained after the modification processing, to obtain the second speech/audio signal.

With reference to the eighth possible implementation manner of the second aspect, in a ninth possible implementation manner of the second aspect, the fourth determining unit is configured to calculate the modification factor by using a formula $\beta=a/L$, where $\beta$ is the modification factor, L is the adaptive normalization length, and a is a constant greater than 1.

With reference to the eighth possible implementation manner of the second aspect and/or the ninth possible implementation manner of the second aspect, in a tenth possible implementation manner of the second aspect, the fourth determining unit is configured to:

perform modification processing on the adjusted amplitude value, which is greater than 0, in the adjusted amplitude values of the sample values by using the following formula:

$$Y=y\times(b-\beta);$$

where Y is the adjusted amplitude value obtained after the modification processing; y is the adjusted amplitude value, which is greater than 0, in the adjusted amplitude values of the sample values; and b is a constant, and $0<b<2$.

In the embodiments, a bitstream is received, and the bitstream is decoded, to obtain a speech/audio signal; a first speech/audio signal is determined according to the speech/audio signal; a symbol of each sample value in the first speech/audio signal and an amplitude value of each sample value in the first speech/audio signal are determined; an adaptive normalization length is determined; an adjusted amplitude value of each sample value is determined according to the adaptive normalization length and the amplitude value of each sample value; and a second speech/audio signal is determined according to the symbol of each sample value and the adjusted amplitude value of each sample value. In this process, only an original signal, that is, the first speech/audio signal is processed, and no new signal is added to the first speech/audio signal, so that no new energy is added to a second speech/audio signal obtained after a noise component is reconstructed. Therefore, if the first speech/audio signal has an onset or an offset, no echo is added to the second speech/audio signal, thereby improving auditory quality of the second speech/audio signal.

It should be understood that, the foregoing general descriptions and the following detailed descriptions are merely exemplary, and do not intend to limit the protection scope of the present invention.

BRIEF DESCRIPTION OF DRAWINGS

To describe the technical solutions in the embodiments of the present invention more clearly, the following briefly introduces the accompanying drawings to facilitate the following description of the embodiments. The accompanying drawings in the following description show merely some embodiments of the present invention, and a person of ordinary skill in the art may still derive other features and advantages from these accompanying drawings without creative efforts.

The foregoing accompanying drawings show specific embodiments of the present invention, and more detailed descriptions are provided in the following. The accompanying drawings and text descriptions are not intended to limit the scope of the idea of the present invention in any manner, but are intended to describe the concept of the present invention for a person skilled in the art with reference to particular embodiments.

DESCRIPTION OF EMBODIMENTS

The following clearly and describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Numerous specific details are mentioned in the following detailed descriptions to provide a thorough understanding of the present invention. However, a person skilled in the art should understand that the present invention may be implemented without these specific details. In other embodiments, a method, a process, a component, and a circuit that are publicly known are not described in detail so as not to unnecessarily obscure the embodiments.

Figure 1:
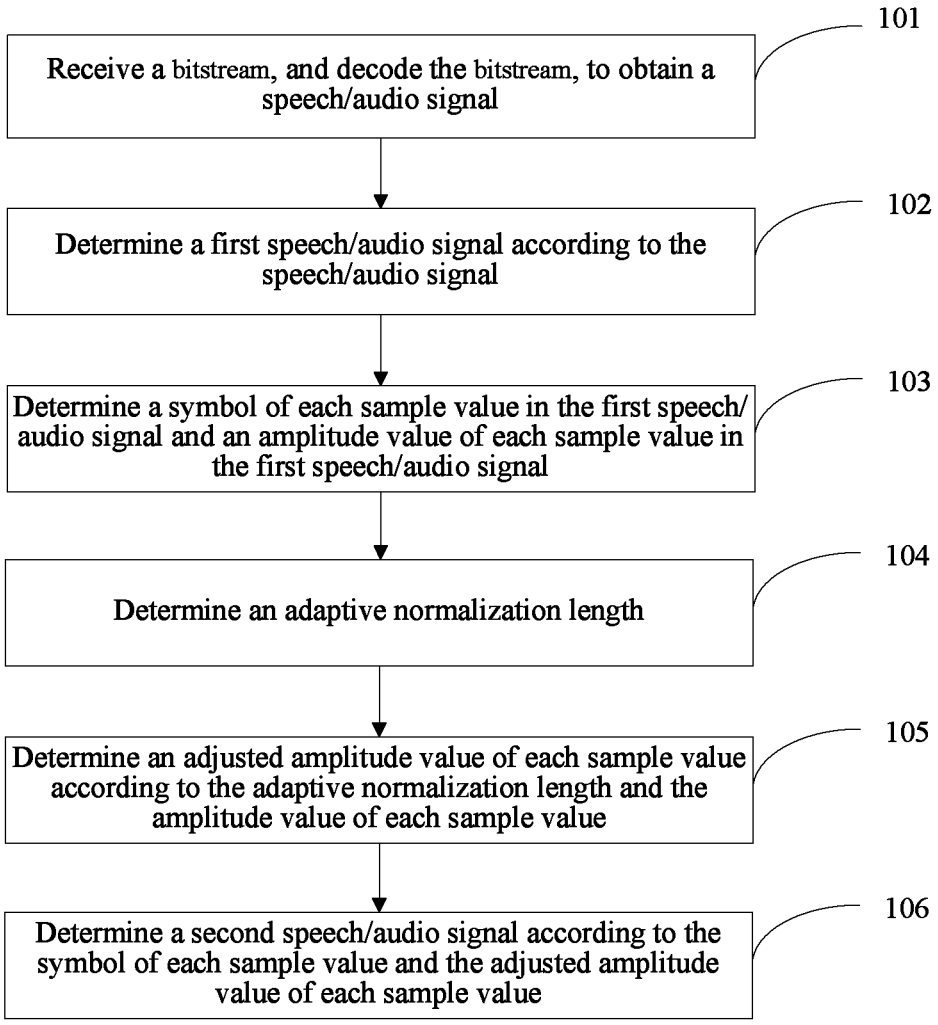
FIG. 1 is a schematic flowchart of a method for reconstructing a noise component of a speech/audio signal according to an embodiment of the present invention.

Referring to FIG. 1, a flowchart is provided of a method for reconstructing a noise component of a speech/audio signal according to an embodiment of the present invention. The method includes:

Step 101: Receive a bitstream, and decode the bitstream, to obtain a speech/audio signal.

Details on how to decode a bitstream, to obtain a speech/audio signal is not described herein.

Step 102: Determine a first speech/audio signal according to the speech/audio signal, where the first speech/audio signal is a signal, whose noise component needs to be reconstructed, in the speech/audio signal obtained by means of decoding.

The first speech/audio signal may be a low frequency band signal, a high frequency band signal, a fullband signal, or the like in the speech/audio signal obtained by means of decoding.

The speech/audio signal obtained by means of decoding may include a low frequency band signal and a high frequency band signal, or may include a fullband signal.

Step 103: Determine a symbol of each sample value in the first speech/audio signal and an amplitude value of each sample value in the first speech/audio signal.

When the first speech/audio signal has different implementation manners, implementation manners of the sample value may also be different. For example, if the first speech/audio signal is a frequency-domain signal, the sample value may be a spectrum coefficient; if the speech/audio signal is a time-domain signal, the sample value may be a sample point value.

Step 104: Determine an adaptive normalization length.

The adaptive normalization length may be determined according to a related parameter of a low frequency band signal and/or a high frequency band signal of the speech/audio signal obtained by means of decoding. Specifically, the related parameter may include a signal type, a peak-to-average ratio, and the like. For example, in a possible implementation manner, the determining an adaptive normalization length may include:

dividing the low frequency band signal in the speech/audio signal into N subbands, where N is a natural number;

calculating a peak-to-average ratio of each subband, and determining a quantity of subbands whose peak-to-average ratios are greater than a preset peak-to-average ratio threshold; and calculating the adaptive normalization length according to a signal type of the high frequency band signal in the speech/audio signal and the quantity of the subbands.

Optionally, the calculating the adaptive normalization length according to a signal type of the high frequency band signal in the speech/audio signal and the quantity of the subbands may include:

calculating the adaptive normalization length according to a formula $L=K+\alpha\times M$, where L is the adaptive normalization length; K is a numerical value corresponding to the signal type of the high frequency band signal in the speech/audio signal, and different signal types of high frequency band signals correspond to different numerical values K; M is the quantity of the subbands whose peak-to-average ratios are greater than the preset peak-to-average ratio threshold; and $\alpha$ is a constant less than 1.

In another possible implementation manner, the adaptive normalization length may be calculated according to a signal type of the low frequency band signal in the speech/audio signal and the quantity of the subbands. For a specific calculation formula, refer to the formula $L=K+\alpha\times M$. A difference lies in only that, in this case, K is a numerical value corresponding to the signal type of the low frequency band signal in the speech/audio signal. Different signal types of low frequency band signals correspond to different numerical values K.

In a third possible implementation manner, the determining an adaptive normalization length may include:

calculating a peak-to-average ratio of the low frequency band signal in the speech/audio signal and a peak-to-average ratio of the high frequency band signal in the speech/audio signal; and when an absolute value of a difference between the peak-to-average ratio of the low frequency band signal and the peak-to-average ratio of the high frequency band signal is less than a preset difference threshold, determining the adaptive normalization length as a preset first length value, or when an absolute value of a difference between the peak-to-average ratio of the low frequency band signal and the peak-to-average ratio of the high frequency band signal is not less than a preset difference threshold, determining the adaptive normalization length as a preset second length value. The first length value is greater than the second length value. The first length value and the second length value may also be obtained by means of calculation by using a ratio of the peak-to-average ratio of the low frequency band signal to the peak-to-average ratio of the high frequency band signal or a difference between the peak-to-average ratio of the low frequency band signal and the peak-to-average ratio of the high frequency band signal. A specific calculation method is not limited.

In a fourth possible implementation manner, the determining an adaptive normalization length may include:

calculating a peak-to-average ratio of the low frequency band signal in the speech/audio signal and a peak-to-average ratio of the high frequency band signal in the speech/audio signal; and when the peak-to-average ratio of the low frequency band signal is less than the peak-to-average ratio of the high frequency band signal, determining the adaptive normalization length as a preset first length value, or when the peak-to-average ratio of the low frequency band signal is not less than the peak-to-average ratio of the high frequency band signal, determining the adaptive normalization length as a preset second length value. The first length value is greater than the second length value. The first length value and the second length value may also be obtained by means of calculation by using a ratio of the peak-to-average ratio of the low frequency band signal to the peak-to-average ratio of the high frequency band signal or a difference between the peak-to-average ratio of the low frequency band signal and the peak-to-average ratio of the high frequency band signal. A specific calculation method is not limited.

In a fifth possible implementation manner, the determining an adaptive normalization length may include: determining the adaptive normalization length according to a signal type of the high frequency band signal in the speech/audio signal. Different signal types correspond to different adaptive normalization lengths. For example, when the signal type is a harmonic signal, a corresponding adaptive normalization length is 32; when the signal type is a normal signal, a corresponding adaptive normalization length is 16; when the signal type is a transient signal, a corresponding adaptive normalization length is 8.

Step 105: Determine an adjusted amplitude value of each sample value according to the adaptive normalization length and the amplitude value of each sample value.

The determining an adjusted amplitude value of each sample value according to the adaptive normalization length and the amplitude value of each sample value may include:

calculating, according to the amplitude value of each sample value and the adaptive normalization length, an average amplitude value corresponding to each sample value, and determining, according to the average amplitude value corresponding to each sample value, an amplitude disturbance value corresponding to each sample value; and calculating the adjusted amplitude value of each sample value according to the amplitude value of each sample value and according to the amplitude disturbance value corresponding to each sample value.

The calculating, according to the amplitude value of each sample value and the adaptive normalization length, an average amplitude value corresponding to each sample value may include:

determining, for each sample value and according to the adaptive normalization length, a subband to which the sample value belongs; and calculating an average value of amplitude values of all sample values in the subband to which the sample value belongs, and using the average value obtained by means of calculation as the average amplitude value corresponding to the sample value.

The determining, for each sample value and according to the adaptive normalization length, a subband to which the sample value belongs may include:

performing subband grouping on all sample values in a preset order according to the adaptive normalization length; and for each sample value, determining a subband including the sample value as the subband to which the sample value belongs.

The preset order may be, for example, an order from a low frequency to a high frequency or an order from a high frequency to a low frequency, which is not limited herein.

Figure 1A:
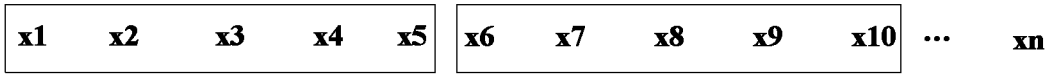
FIG. 1A is a schematic diagram of an example of grouping sample values according to an embodiment of the present invention.

For example, referring to FIG. 1A, assuming that sample values in ascending order are respectively x1, x2, x3, . . . , and xn, and the adaptive normalization length is 5, x1 to x5 may be grouped into one subband, and x6 to x10 may be grouped into one subband. By analogy, several subbands are obtained. Therefore, for each sample value in x1 to x5, a subband x1 to x5 is a subband to which each sample value belongs, and for each sample value in x6 to x10, a subband x6 to x10 is a subband to which each sample value belongs.

Alternatively, the determining, for each sample value and according to the adaptive normalization length, a subband to which the sample value belongs may include:

for each sample value, determining a subband consisting of m sample values before the sample value, the sample value, and n sample values after the sample value as the subband to which the sample value belongs, where m and n depend on the adaptive normalization length, m is an integer not less than 0, and n is an integer not less than 0.

Figure 1B:
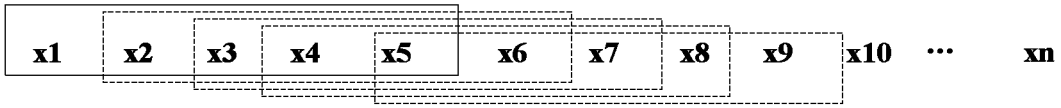
FIG. 1B is another schematic diagram of an example of grouping sample values according to an embodiment of the present invention.

For example, referring to FIG. 1B, it is assumed that sample values in ascending order are respectively x1, x2, x3, . . . , and xn, the adaptive normalization length is 5, m is 2, and n is 2. For the sample value x3, a subband consisting of x1 to x5 is a subband to which the sample value x3 belongs. For the sample value x4, a subband consisting of x2 to x6 is a subband to which the sample value x4 belongs. The rest can be deduced by analogy. Because there is not enough sample values before the sample values x1 and x2 to form subbands to which the sample values x1 and x2 belong, and there is not enough sample values after the sample values x(n−1) and xn to form subbands to which the sample values x(n−1) and xn belong, in an actual application, the subbands to which x1, x2, x(n−1), and xn belong may be autonomously set. For example, the sample value itself may be added to compensate for a lack of a sample value in the subband to which the sample value belongs. For example, for the sample value x1, there is no sample value before the sample value x1, and x1, x1, x1, x2, and x3 may be used as the subband to which the sample value x1 belongs.

When the amplitude disturbance value corresponding to each sample value is determined according to the average amplitude value corresponding to each sample value, the average amplitude value corresponding to each sample value may be directly used as the amplitude disturbance value corresponding to each sample value. Alternatively, a preset operation may be performed on the average amplitude value corresponding to each sample value, to obtain the amplitude disturbance value corresponding to each sample value. The preset operation may be, for example, that the average amplitude value is multiplied by a numerical value. The numerical value is generally greater than 0.

The calculating the adjusted amplitude value of each sample value according to the amplitude value of each sample value and according to the amplitude disturbance value corresponding to each sample value may include:

subtracting the amplitude disturbance value corresponding to each sample value from the amplitude value of each sample value, to obtain a difference between the amplitude value of each sample value and the amplitude disturbance value corresponding to each sample value, and using the obtained difference as the adjusted amplitude value of each sample value.

Step 106: Determine a second speech/audio signal according to the symbol of each sample value and the adjusted amplitude value of each sample value, where the second speech/audio signal is a signal obtained after the noise component of the first speech/audio signal is reconstructed.

In a possible implementation manner, a new value of each sample value may be determined according to the symbol and the adjusted amplitude value of each sample value, to obtain the second speech/audio signal.

In another possible implementation manner, the determining a second speech/audio signal according to the symbol of each sample value and the adjusted amplitude value of each sample value may include:

calculating a modification factor;

performing modification processing on an adjusted amplitude value, which is greater than 0, in the adjusted amplitude values of the sample values according to the modification factor; and determining a new value of each sample value according to the symbol of each sample value and an adjusted amplitude value that is obtained after the modification processing, to obtain the second speech/audio signal.

In a possible implementation manner, the obtained second speech/audio signal may include new values of all the sample values.

The modification factor may be calculated according to the adaptive normalization length. Specifically, the modification factor $\beta$ may be equal to a/L, where a is a constant greater than 1.

The performing modification processing on an adjusted amplitude value, which is greater than 0, in the adjusted amplitude values of the sample values according to the modification factor may include:

performing modification processing on the adjusted amplitude value, which is greater than 0, in the adjusted amplitude values of the sample values by using the following formula:

$$Y=y\times(b-\beta);$$

where Y is the adjusted amplitude value obtained after the modification processing; y is the adjusted amplitude value, which is greater than 0, in the adjusted amplitude values of the sample values; and b is a constant, and $0<b<2$.

The step of extracting the symbol of each sample value in the first speech/audio signal in step 103 may be performed at any time before step 106. There is no necessary execution order between the step of extracting the symbol of each sample value in the first speech/audio signal and step 104 and step 105.

An execution order between step 103 and step 104 is not limited.

In the prior art, when a speech/audio signal is a signal having an onset or an offset, a time-domain signal in the speech/audio signal may be within one frame. In this case, a part of the speech/audio signal has an extremely large signal sample point value and extremely powerful signal energy, while another part of the speech/audio signal has an extremely small signal sample point value and extremely weak signal energy. In this case, a random noise signal is added to the speech/audio signal in a frequency domain, to obtain a signal obtained after a noise component is reconstructed. Because energy of the random noise signal is even within one frame in a time domain, when a frequency-domain signal obtained after a noise component is reconstructed is converted into a time-domain signal, the newly added random noise signal generally causes signal energy of a part, whose original sample point value is extremely small, in the time-domain signal obtained by means of conversion to increase. A signal sample point value of this part also correspondingly becomes relatively large. Consequently, the signal obtained after a noise component is reconstructed has some echoes, which affects auditory quality of the signal obtained after a noise component is reconstructed.

In this embodiment, a first speech/audio signal is determined according to a speech/audio signal; a symbol of each sample value in the first speech/audio signal and an amplitude value of each sample value in the first speech/audio signal are determined; an adaptive normalization length is determined; an adjusted amplitude value of each sample value is determined according to the adaptive normalization length and the amplitude value of each sample value; and a second speech/audio signal is determined according to the symbol of each sample value and the adjusted amplitude value of each sample value. In this process, only an original signal, that is, the first speech/audio signal is processed, and no new signal is added to the first speech/audio signal, so that no new energy is added to a second speech/audio signal obtained after a noise component is reconstructed. Therefore, if the first speech/audio signal has an onset or an offset, no echo is added to the second speech/audio signal, thereby improving auditory quality of the second speech/audio signal.

Figure 2:
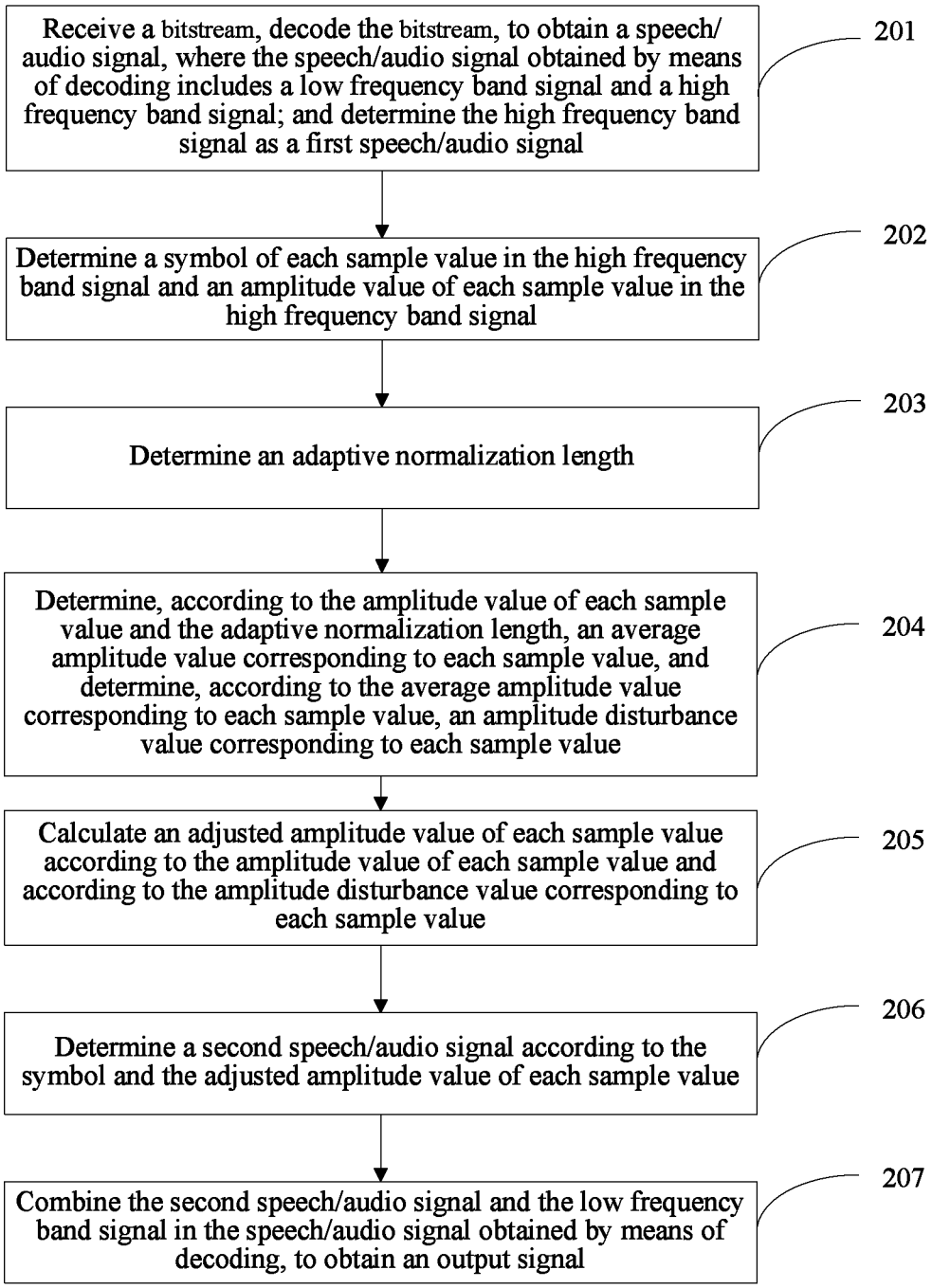
FIG. 2 is a schematic flowchart of another method for reconstructing a noise component of a speech/audio signal according to an embodiment of the present invention.

Referring to FIG. 2, FIG. 2 is another schematic flowchart of a method for reconstructing a noise component of a speech/audio signal according to an embodiment of the present invention. The method includes:

Step 201: Receive a bitstream, decode the bitstream, to obtain a speech/audio signal, where the speech/audio signal obtained by means of decoding includes a low frequency band signal and a high frequency band signal; and determine the high frequency band signal as a first speech/audio signal.

How to decode the bitstream is not limited in the present invention.

Step 202: Determine a symbol of each sample value in the high frequency band signal and an amplitude value of each sample value in the high frequency band signal.

For example, if a coefficient of a sample value in the high frequency band signal is −4, a symbol of the sample value is "−", and an amplitude value is 4.

Step 203: Determine an adaptive normalization length.

For details on how to determine the adaptive normalization length, refer to related descriptions in step 104. Details are not described herein again.

Step 204: Determine, according to the amplitude value of each sample value and the adaptive normalization length, an average amplitude value corresponding to each sample value, and determine, according to the average amplitude value corresponding to each sample value, an amplitude disturbance value corresponding to each sample value.

For how to determine the average amplitude value corresponding to each sample value, refer to related descriptions in step 105. Details are not described herein again.

Step 205: Calculate an adjusted amplitude value of each sample value according to the amplitude value of each sample value and according to the amplitude disturbance value corresponding to each sample value.

For how to determine the adjusted amplitude value of each sample value, refer to related descriptions in step 105. Details are not described herein again.

Step 206: Determine a second speech/audio signal according to the symbol and the adjusted amplitude value of each sample value.

The second speech/audio signal is a signal obtained after a noise component of the first speech/audio signal is reconstructed.

For specific implementation in this step, refer to related descriptions in step 106. Details are not described herein again.

The step of determining the symbol of each sample value in the first speech/audio signal in step 202 may be performed at any time before step 206. There is no necessary execution order between the step of determining the symbol of each sample value in the first speech/audio signal and step 203, step 204, and step 205.

An execution order between step 202 and step 203 is not limited.

Step 207: Combine the second speech/audio signal and the low frequency band signal in the speech/audio signal obtained by means of decoding, to obtain an output signal.

If the first speech/audio signal is a low frequency band signal in the speech/audio signal obtained by means of decoding, the second speech/audio signal and a high frequency band signal in the speech/audio signal obtained by means of decoding may be combined, to obtain an output signal.

If the first speech/audio signal is a high frequency band signal in the speech/audio signal obtained by means of decoding, the second speech/audio signal and a low frequency band signal in the speech/audio signal obtained by means of decoding may be combined, to obtain an output signal.

If the first speech/audio signal is a fullband signal in the speech/audio signal obtained by means of decoding, the second speech/audio signal may be directly determined as the output signal.

In this embodiment, by reconstructing a noise component of a high frequency band signal in a speech/audio signal obtained by means of decoding, the noise component of the high frequency band signal is finally reconstructed, to obtain a second speech/audio signal. Therefore, if the high frequency band signal has an onset or an offset, no echo is added to the second speech/audio signal, thereby improving auditory quality of the second speech/audio signal and further improving auditory quality of the output signal finally output.

Figure 3:
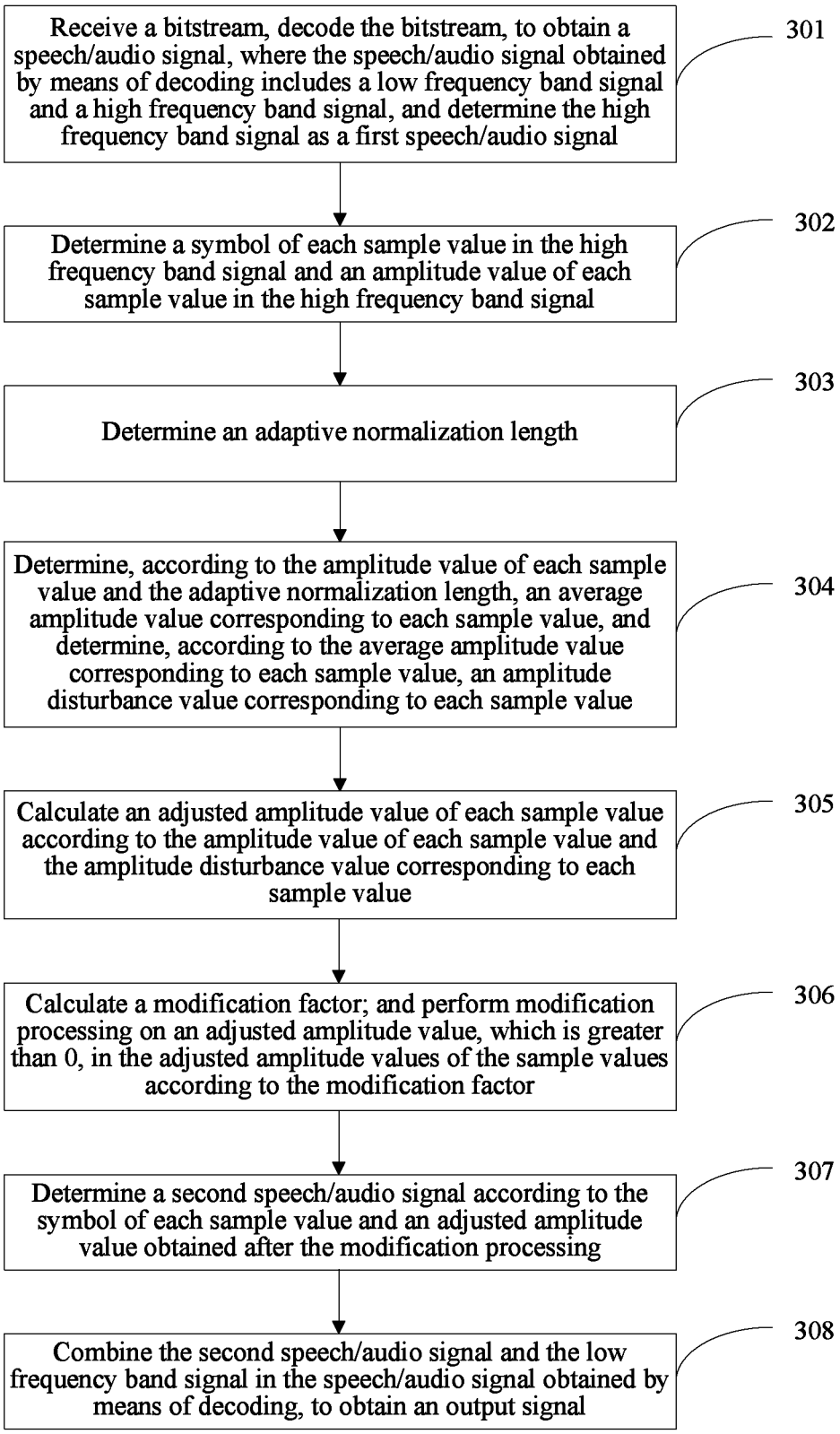
FIG. 3 is a schematic flowchart of another method for reconstructing a noise component of a speech/audio signal according to an embodiment of the present invention.

Referring to FIG. 3, FIG. 3 is another schematic flowchart of a method for reconstructing a noise component of a speech/audio signal according to an embodiment of the present invention. The method includes:

Step 301 to step 305 are the same as step 201 to step 205, and details are not described herein again.

Step 306: Calculate a modification factor; and perform modification processing on an adjusted amplitude value, which is greater than 0, in the adjusted amplitude values of the sample values according to the modification factor.

For specific implementation in this step, refer to related descriptions in step 106. Details are not described herein again.

Step 307: Determine a second speech/audio signal according to the symbol of each sample value and an adjusted amplitude value obtained after the modification processing.

For specific implementation in this step, refer to related descriptions in step 106. Details are not described herein again.

The step of determining the symbol of each sample value in the first speech/audio signal in step 302 may be performed at any time before step 307. There is no necessary execution order between the step of determining the symbol of each sample value in the first speech/audio signal and step 303, step 304, step 305, and step 306.

An execution order between step 302 and step 303 is not limited.

Step 308: Combine the second speech/audio signal and a low frequency band signal in the speech/audio signal obtained by means of decoding, to obtain an output signal.

Relative to the embodiment shown in FIG. 2, in this embodiment, after the adjusted amplitude value of each sample value is obtained, and an adjusted amplitude value, which is greater than 0, in the adjusted amplitude values is further modified, thereby further improving auditory quality of the second speech/audio signal, and further improving auditory quality of the output signal finally output.

In the exemplary methods for reconstructing a noise component of a speech/audio signal in FIG. 2 and FIG. 3 according to the embodiments of the present invention, a high frequency band signal in the speech/audio signal obtained by means of decoding is determined as the first speech/audio signal, and a noise component of the first speech/audio signal is reconstructed, to finally obtain the second speech/audio signal. In an actual application, according to the method for reconstructing a noise component of a speech/audio signal according to the embodiments of the present invention, a noise component of a fullband signal of the speech/audio signal obtained by means of decoding may be reconstructed, or a noise component of a low frequency band signal of the speech/audio signal obtained by means of decoding is reconstructed, to finally obtain a second speech/audio signal. For an implementation process thereof, refer to the exemplary methods shown in FIG. 2 and FIG. 3. A difference lies in only that, when a first speech/audio signal is to be determined, a fullband signal or a low frequency band signal is determined as the first speech/audio signal. Descriptions are not provided by using examples one by one herein.

Figure 4:
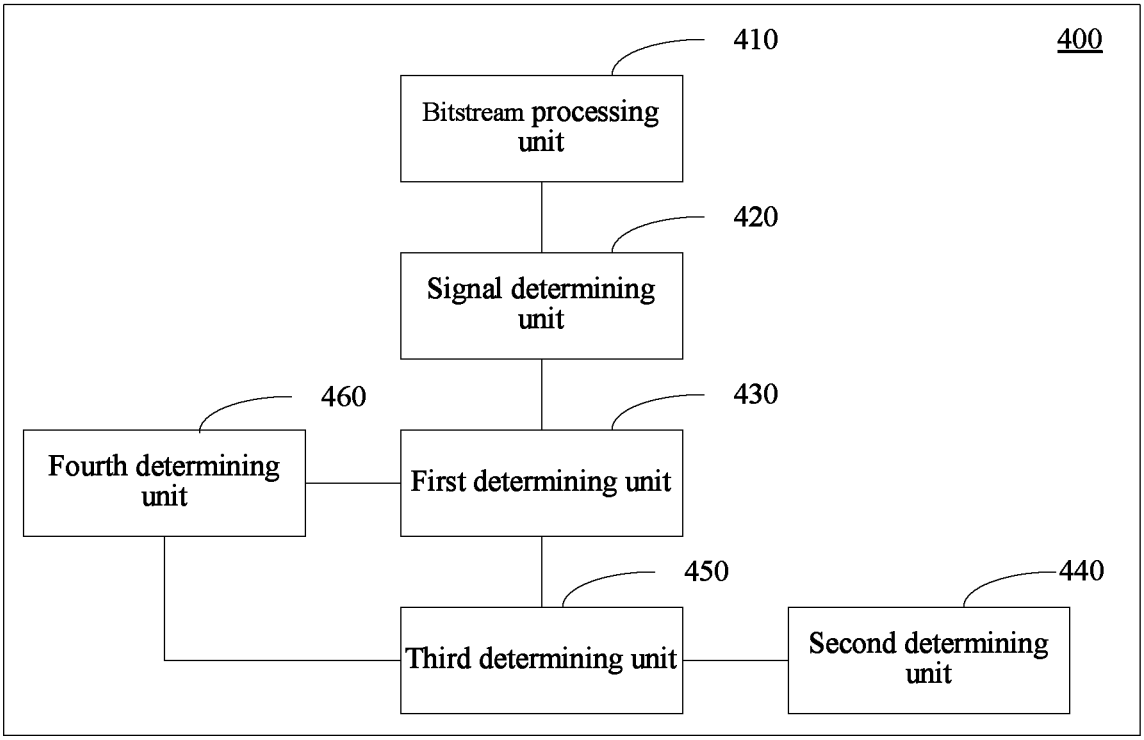
FIG. 4 is a schematic structural diagram of an apparatus for reconstructing a noise component of a speech/audio signal according to an embodiment of the present invention.

Referring to FIG. 4, FIG. 4 is a schematic structural diagram of an apparatus for reconstructing a noise component of a speech/audio signal according to an embodiment of the present invention. The apparatus may be disposed in an electronic device. An apparatus 400 may include:

a bitstream processing unit 410, configured to receive a bitstream and decode the bitstream, to obtain a speech/audio signal; and determine a first speech/audio signal according to the speech/audio signal, where the first speech/audio signal is a signal, whose noise component needs to be reconstructed, in the speech/audio signal obtained by means of decoding;

a signal determining unit 420, configured to determine the first speech/audio signal according to the speech/audio signal obtained by the bitstream processing unit 410;

a first determining unit 430, configured to determine a symbol of each sample value in the first speech/audio signal determined by the signal determining unit 420 and an amplitude value of each sample value in the first speech/audio signal determined by the signal determining unit 420;

a second determining unit 440, configured to determine an adaptive normalization length;

a third determining unit 450, configured to determine an adjusted amplitude value of each sample value according to the adaptive normalization length determined by the second determining unit 440 and the amplitude value that is of each sample value and is determined by the first determining unit 430; and a fourth determining unit 460, configured to determine a second speech/audio signal according to the symbol that is of each sample value and is determined by the first determining unit 430 and the adjusted amplitude value that is of each sample value and is determined by the third determining unit 450, where the second speech/audio signal is a signal obtained after the noise component of the first speech/audio signal is reconstructed.

Optionally, the third determining unit 450 may include:

a determining subunit, configured to calculate, according to the amplitude value of each sample value and the adaptive normalization length, an average amplitude value corresponding to each sample value, and determine, according to the average amplitude value corresponding to each sample value, an amplitude disturbance value corresponding to each sample value; and an adjusted amplitude value calculation subunit, configured to calculate the adjusted amplitude value of each sample value according to the amplitude value of each sample value and according to the amplitude disturbance value corresponding to each sample value.

Optionally, the determining subunit may include:

a determining module, configured to determine, for each sample value and according to the adaptive normalization length, a subband to which the sample value belongs; and a calculation module, configured to calculate an average value of amplitude values of all sample values in the subband to which the sample value belongs, and use the average value obtained by means of calculation as the average amplitude value corresponding to the sample value.

Optionally, the determining module may be configured to:

perform subband grouping on all sample values in a preset order according to the adaptive normalization length; and for each sample value, determine a subband including the sample value as the subband to which the sample value belongs; or for each sample value, determine a subband consisting of m sample values before the sample value, the sample value, and n sample values after the sample value as the subband to which the sample value belongs, where m and n depend on the adaptive normalization length, m is an integer not less than 0, and n is an integer not less than 0.

Optionally, the adjusted amplitude value calculation subunit may be configured to:

subtract the amplitude disturbance value corresponding to each sample value from the amplitude value of each sample value, to obtain a difference between the amplitude value of each sample value and the amplitude disturbance value corresponding to each sample value, and use the obtained difference as the adjusted amplitude value of each sample value.

Optionally, the second determining unit 440 may include:

a division subunit, configured to divide a low frequency band signal in the speech/audio signal into N subbands, where N is a natural number;

a quantity determining subunit, configured to calculate a peak-to-average ratio of each subband, and determine a quantity of subbands whose peak-to-average ratios are greater than a preset peak-to-average ratio threshold; and a length calculation subunit, configured to calculate the adaptive normalization length according to a signal type of a high frequency band signal in the speech/audio signal and the quantity of the subbands.

Optionally, the length calculation subunit may be configured to:

calculate the adaptive normalization length according to a formula $L=K+\alpha\times M$, where L is the adaptive normalization length; K is a numerical value corresponding to the signal type of the high frequency band signal in the speech/audio signal, and different signal types of high frequency band signals correspond to different numerical values K; M is the quantity of the subbands whose peak-to-average ratios are greater than the preset peak-to-average ratio threshold; and $\alpha$ is a constant less than 1.

Optionally, the second determining unit 440 may be configured to:

calculate a peak-to-average ratio of a low frequency band signal in the speech/audio signal and a peak-to-average ratio of a high frequency band signal in the speech/audio signal; and when an absolute value of a difference between the peak-to-average ratio of the low frequency band signal and the peak-to-average ratio of the high frequency band signal is less than a preset difference threshold, determine the adaptive normalization length as a preset first length value, or when an absolute value of a difference between the peak-to-average ratio of the low frequency band signal and the peak-to-average ratio of the high frequency band signal is not less than a preset difference threshold, determine the adaptive normalization length as a preset second length value, where the first length value is greater than the second length value; or calculate a peak-to-average ratio of a low frequency band signal in the speech/audio signal and a peak-to-average ratio of a high frequency band signal in the speech/audio signal; and when the peak-to-average ratio of the low frequency band signal is less than the peak-to-average ratio of the high frequency band signal, determine the adaptive normalization length as a preset first length value, or when the peak-to-average ratio of the low frequency band signal is not less than the peak-to-average ratio of the high frequency band signal, determine the adaptive normalization length as a preset second length value; or determine the adaptive normalization length according to a signal type of a high frequency band signal in the speech/audio signal, where different signal types of high frequency band signals correspond to different adaptive normalization lengths.

Optionally, the fourth determining unit 460 may be configured to:

determine a new value of each sample value according to the symbol and the adjusted amplitude value of each sample value, to obtain the second speech/audio signal; or calculate a modification factor; perform modification processing on an adjusted amplitude value, which is greater than 0, in the adjusted amplitude values of the sample values according to the modification factor; and determine a new value of each sample value according to the symbol of each sample value and an adjusted amplitude value that is obtained after the modification processing, to obtain the second speech/audio signal.

Optionally, the fourth determining unit 460 may be configured to calculate the modification factor by using a formula $\beta=a/L$, where $\beta$ is the modification factor, L is the adaptive normalization length, and a is a constant greater than 1.

Optionally, the fourth determining unit 460 may be configured to:

perform modification processing on the adjusted amplitude value, which is greater than 0, in the adjusted amplitude values of the sample values by using the following formula:

$$Y=y\times(b-\beta);$$

where Y is the adjusted amplitude value obtained after the modification processing; y is the adjusted amplitude value, which is greater than 0, in the adjusted amplitude values of the sample values; and b is a constant, and $0<b<2$.

In this embodiment, a first speech/audio signal is determined according to a speech/audio signal; a symbol of each sample value in the first speech/audio signal and an amplitude value of each sample value in the first speech/audio signal are determined; an adaptive normalization length is determined; an adjusted amplitude value of each sample value is determined according to the adaptive normalization length and the amplitude value of each sample value; and a second speech/audio signal is determined according to the symbol of each sample value and the adjusted amplitude value of each sample value. In this process, only an original signal, that is, the first speech/audio signal is processed, and no new signal is added to the first speech/audio signal, so that no new energy is added to a second speech/audio signal obtained after a noise component is reconstructed. Therefore, if the first speech/audio signal has an onset or an offset, no echo is added to the second speech/audio signal, thereby improving auditory quality of the second speech/audio signal.

Figure 5:
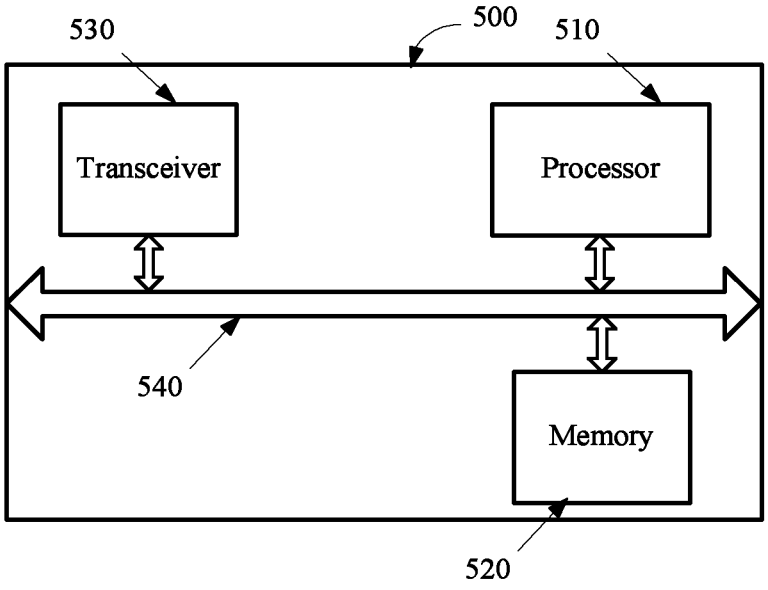
FIG. 5 is a schematic structural diagram of an electronic device according to an embodiment of the present invention.

Referring to FIG. 5, FIG. 5 is a structural diagram of an electronic device according to an embodiment of the present invention. An electronic device 500 includes a processor 510, a memory 520, a transceiver 530, and a bus 540.

The processor 510, the memory 520, and the transceiver 530 are connected to each other by using the bus 540, and the bus 540 may be an ISA bus, a PCI bus, an EISA bus, or the like. The bus may be classified into an address bus, a data bus, a control bus, or the like. For ease of indication, the bus shown in FIG. 5 is indicated by using only one bold line, but it does not indicate that there is only one bus or only one type of bus.

The memory 520 is configured to store a program. Specifically, the program may include program code, and the program code includes a computer operation instruction. The memory 520 may include a high-speed RAM memory, and may further include a non-volatile memory (non-volatile memory), such as at least one magnetic disk storage.

The transceiver 530 is configured to connect to another device, and communicate with the another device. Specifically, the transceiver 530 may be configured to receive a bitstream.

The processor 510 executes the program code stored in the memory 520 and is configured to: decode the bitstream, to obtain a speech/audio signal; determine a first speech/audio signal according to the speech/audio signal; determine a symbol of each sample value in the first speech/audio signal and an amplitude value of each sample value in the first speech/audio signal; determine an adaptive normalization length; determine an adjusted amplitude value of each sample value according to the adaptive normalization length and the amplitude value of each sample value; and determine a second speech/audio signal according to the symbol of each sample value and the adjusted amplitude value of each sample value.

Optionally, the processor 510 may be configured to:

calculate, according to the amplitude value of each sample value and the adaptive normalization length, an average amplitude value corresponding to each sample value, and determine, according to the average amplitude value corresponding to each sample value, an amplitude disturbance value corresponding to each sample value; and calculate the adjusted amplitude value of each sample value according to the amplitude value of each sample value and according to the amplitude disturbance value corresponding to each sample value.

Optionally, the processor 510 may be configured to:

determine, for each sample value and according to the adaptive normalization length, a subband to which the sample value belongs; and calculate an average value of amplitude values of all sample values in the subband to which the sample value belongs, and use the average value obtained by means of calculation as the average amplitude value corresponding to the sample value.

Optionally, the processor 510 may be configured to:

perform subband grouping on all sample values in a preset order according to the adaptive normalization length; and for each sample value, determine a subband including the sample value as the subband to which the sample value belongs; or for each sample value, determine a subband consisting of m sample values before the sample value, the sample value, and n sample values after the sample value as the subband to which the sample value belongs, where m and n depend on the adaptive normalization length, m is an integer not less than 0, and n is an integer not less than 0.

Optionally, the processor 510 may be configured to:

subtract the amplitude disturbance value corresponding to each sample value from the amplitude value of each sample value, to obtain a difference between the amplitude value of each sample value and the amplitude disturbance value corresponding to each sample value, and use the obtained difference as the adjusted amplitude value of each sample value.

Optionally, the processor 510 may be configured to:

divide a low frequency band signal in the speech/audio signal into N subbands, where N is a natural number;

calculate a peak-to-average ratio of each subband, and determine a quantity of subbands whose peak-to-average ratios are greater than a preset peak-to-average ratio threshold; and calculate the adaptive normalization length according to a signal type of a high frequency band signal in the speech/audio signal and the quantity of the subbands.

Optionally, the processor 510 may be configured to:

calculate the adaptive normalization length according to a formula $L=K+\alpha\times M$ where L is the adaptive normalization length; K is a numerical value corresponding to the signal type of the high frequency band signal in the speech/audio signal, and different signal types of high frequency band signals correspond to different numerical values K; M is the quantity of the subbands whose peak-to-average ratios are greater than the preset peak-to-average ratio threshold; and $\alpha$ is a constant less than 1.

Optionally, the processor 510 may be configured to:

calculate a peak-to-average ratio of a low frequency band signal in the speech/audio signal and a peak-to-average ratio of a high frequency band signal in the speech/audio signal; and when an absolute value of a difference between the peak-to-average ratio of the low frequency band signal and the peak-to-average ratio of the high frequency band signal is less than a preset difference threshold, determine the adaptive normalization length as a preset first length value, or when an absolute value of a difference between the peak-to-average ratio of the low frequency band signal and the peak-to-average ratio of the high frequency band signal is not less than a preset difference threshold, determine the adaptive normalization length as a preset second length value, where the first length value is greater than the second length value; or calculate a peak-to-average ratio of a low frequency band signal in the speech/audio signal and a peak-to-average ratio of a high frequency band signal in the speech/audio signal; and when the peak-to-average ratio of the low frequency band signal is less than the peak-to-average ratio of the high frequency band signal, determine the adaptive normalization length as a preset first length value, or when the peak-to-average ratio of the low frequency band signal is not less than the peak-to-average ratio of the high frequency band signal, determine the adaptive normalization length as a preset second length value; or determine the adaptive normalization length according to a signal type of a high frequency band signal in the speech/audio signal, where different signal types of high frequency band signals correspond to different adaptive normalization lengths.

Optionally, the processor 510 may be configured to:

determine a new value of each sample value according to the symbol and the adjusted amplitude value of each sample value, to obtain the second speech/audio signal; or calculate a modification factor; perform modification processing on an adjusted amplitude value, which is greater than 0, in the adjusted amplitude values of the sample values according to the modification factor; and determine a new value of each sample value according to the symbol of each sample value and an adjusted amplitude value that is obtained after the modification processing, to obtain the second speech/audio signal.

Optionally, the processor 510 may be configured to:

calculate the modification factor by using a formula $\beta=a/L$, where $\beta$ is the modification factor, L is the adaptive normalization length, and a is a constant greater than 1.

Optionally, the processor 510 may be configured to:

perform modification processing on the adjusted amplitude value, which is greater than 0, in the adjusted amplitude values of the sample values by using the following formula:

$$Y=y\times(b-\beta);$$

where Y is the adjusted amplitude value obtained after the modification processing; y is the adjusted amplitude value, which is greater than 0, in the adjusted amplitude values of the sample values; and b is a constant, and $0<b<2$.

In this embodiment, the electronic device determines a first speech/audio signal according to a speech/audio signal; determines a symbol of each sample value in the first speech/audio signal and an amplitude value of each sample value in the first speech/audio signal; determines an adaptive normalization length; determines an adjusted amplitude value of each sample value according to the adaptive normalization length and the amplitude value of each sample value; and determines a second speech/audio signal according to the symbol of each sample value and the adjusted amplitude value of each sample value. In this process, only an original signal, that is, the first speech/audio signal is processed, and no new signal is added to the first speech/audio signal, so that no new energy is added to a second speech/audio signal obtained after a noise component is reconstructed. Therefore, if the first speech/audio signal has an onset or an offset, no echo is added to the second speech/audio signal, thereby improving auditory quality of the second speech/audio signal.

A system embodiment basically corresponds to a method embodiment, and therefore for related parts, reference may be made to partial descriptions in the method embodiment. The described system embodiment is merely exemplary. The units described as separate parts may or may not be physically separate, and parts displayed as units may or may not be physical units, may be located in one position, or may be distributed on a plurality of network units. A part or all of the modules may be selected according to actual needs to achieve the objectives of the solutions of the embodiments. A person of ordinary skill in the art may understand and implement the embodiments of the present invention without creative efforts.

The present invention can be described in the general context of executable computer instructions executed by a computer, for example, a program module. Generally, the program unit includes a routine, a program, an object, a component, a data structure, and the like for executing a particular task or implementing a particular abstract data type. The present invention may also be practiced in distributed computing environments in which tasks are performed by remote processing devices that are connected by using a communications network. In a distributed computing environment, program modules may be located in both local and remote computer storage media including storage devices.

A person of ordinary skill in the art may understand that all or a part of the steps of the implementation manners in the method may be implemented by a program instructing relevant hardware. The program may be stored in a computer readable storage medium, such as a ROM, a RAM, a magnetic disc, or an optical disc.

It should be further noted that in the specification, relational terms such as first and second are used only to differentiate an entity or operation from another entity or operation, and do not require or imply that any actual relationship or sequence exists between these entities or operations. Moreover, the terms "include", "comprise", or their any other variant is intended to cover a non-exclusive inclusion, so that a process, a method, an article, or a device that includes a list of elements not only includes those elements but also includes other elements which are not expressly listed, or further includes elements inherent to such process, method, article, or apparatus. An element preceded by "includes a . . . " does not, without more constraints, preclude the existence of additional identical elements in the process, method, article, or apparatus that includes the element.

The foregoing descriptions are merely exemplary embodiments of the present invention, and are not intended to limit the protection scope of the present invention. In this specification, specific examples are used to describe the principle and implementation manners of the present invention, and the description of the embodiments is only intended to make the method and core idea of the present invention more comprehensible. Moreover, a person of ordinary skill in the art may, based on the idea of the present invention, make modifications with respect to the specific implementation manners and the application scope. In conclusion, the content in this specification shall not be construed as a limitation to the present invention. Any modification, equivalent replacement, or improvement made without departing from the principle of the present invention shall fall within the protection scope of the present invention.

What is claimed is:

1. A method for processing a speech/audio signal, wherein the method comprises:

receiving a bitstream;

decoding the bitstream to obtain a speech/audio signal;

determining a first speech/audio signal according to the speech/audio signal, wherein the first speech/audio signal includes a noise component;

determining a symbol of each sample value in the first speech/audio signal and an amplitude value of each sample value in the first speech/audio signal;

determining an adaptive normalization length;

determining an adjusted amplitude value of each sample value according to the adaptive normalization length and the amplitude value of each sample value;

reconstructing the noise component of the first speech/audio signal by determining a second speech/audio signal according to the symbol of each sample value and the adjusted amplitude value of each sample value;

wherein determining an adjusted amplitude value of each sample value comprises:

calculating, according to the amplitude value of each sample value and the adaptive normalization length, an average amplitude value corresponding to each sample value and determining, according to the average amplitude value corresponding to each sample value, an amplitude disturbance value corresponding to each sample value; wherein, the average amplitude value corresponding to each sample value is the average amplitude value of the sum of values of all sample values in the subband to which the sample value belongs relative to the adaptive normalization length; and calculating the adjusted amplitude value of each sample value according to the amplitude value of each sample value and according to the amplitude disturbance value corresponding to each sample value.

2. The method according to claim 1, wherein calculating, according to the amplitude value of each sample value and the adaptive normalization length, an average amplitude value corresponding to each sample value comprises:

determining, for each sample value and according to the adaptive normalization length, a subband to which the sample value belongs; and calculating an average value of amplitude values of all sample values in the subband to which the sample value belongs, and using the average value of amplitude values as the average amplitude value corresponding to the sample value.

3. The method according to claim 1, wherein determining a subband to which the sample value belongs comprises:

performing subband grouping on all sample values in a preset order according to the adaptive normalization length, and for each sample value, determining a subband comprising the sample value as the subband to which the sample value belongs.

4. The method according to claim 1, wherein determining a subband to which the sample value belongs comprises:

for each sample value, determining a subband consisting of m sample values before the sample value, the sample value, and n sample values after the sample value as the subband to which the sample value belongs, wherein m and n depend on the adaptive normalization length, m is an integer not less than 0, and n is an integer not less than 0.

5. The method according to claim 1, wherein calculating the adjusted amplitude value of each sample value comprises:

subtracting the amplitude disturbance value corresponding to each sample value from the amplitude value of each sample value, to obtain a difference between the amplitude value of each sample value and the amplitude disturbance value corresponding to each sample value, and using the obtained difference as the adjusted amplitude value of each sample value.

6. The method according to claim 5, wherein calculating the adaptive normalization length comprises:

calculating the adaptive normalization length according to a formula $L=K+\alpha\times M$, wherein L is the adaptive normalization length; K is a numerical value corresponding to the signal type of the high frequency band signal in the speech/audio signal, and different signal types of high frequency band signals correspond to different numerical values K; M is the quantity of the subbands whose peak-to-average ratios are greater than the preset peak-to-average ratio threshold; and $\alpha$ is a constant less than 1.

7. The method according to claim 1, wherein determining an adaptive normalization length comprises:

dividing a low frequency band signal in the speech/audio signal into N subbands, wherein N is a natural number;

calculating a peak-to-average ratio of each subband, and determining a quantity of subbands whose peak-to-average ratios are greater than a preset peak-to-average ratio threshold;

and calculating the adaptive normalization length according to a signal type of a high frequency band signal in the speech/audio signal and the quantity of the subbands.

8. The method according to claim 1, wherein determining an adaptive normalization length comprises:

calculating a peak-to-average ratio of a low frequency band signal in the speech/audio signal and a peak-to-average ratio of a high frequency band signal in the speech/audio signal; and when an absolute value of a difference between the peak-to-average ratio of the low frequency band signal and the peak-to-average ratio of the high frequency band signal is less than a preset difference threshold, determining the adaptive normalization length as a preset first length value, or when an absolute value of a difference between the peak-to-average ratio of the low frequency band signal and the peak-to-average ratio of the high frequency band signal is not less than a preset difference threshold, determining the adaptive normalization length as a preset second length value, wherein the first length value is greater than the second length value.

9. The method according to claim 1, wherein determining an adaptive normalization length comprises:

calculating a peak-to-average ratio of a low frequency band signal in the speech/audio signal and a peak-to-average ratio of a high frequency band signal in the speech/audio signal; and when the peak-to-average ratio of the low frequency band signal is less than the peak-to-average ratio of the high frequency band signal, determining the adaptive normalization length as a preset first length value, or when the peak-to-average ratio of the low frequency band signal is not less than the peak-to-average ratio of the high frequency band signal, determining the adaptive normalization length as a preset second length value.

10. The method according to claim 1, wherein determining an adaptive normalization length comprises:

determining the adaptive normalization length according to a signal type of a high frequency band signal in the speech/audio signal, wherein different signal types of high frequency band signals correspond to different adaptive normalization lengths.

11. The method according to claim 1, wherein determining a second speech/audio signal according to the symbol of each sample value and the adjusted amplitude value of each sample value comprises:

calculating a modification factor; performing modification processing on an adjusted amplitude value, which is greater than 0, in the adjusted amplitude values of the sample values according to the modification factor; and determining a new value of each sample value according to the symbol of each sample value and an adjusted amplitude value that is obtained after the modification processing, to obtain the second speech/audio signal.

12. The method according to claim 11, wherein calculating a modification factor comprises:

using a formula $\beta=a/L$, where $\beta$ is the modification factor, L is the adaptive normalization length, and a is a constant greater than 1.

13. The method according to claim 11, wherein performing modification processing comprises:

using the formula:

$$Y=y=(b-\beta);$$

where Y is the adjusted amplitude value obtained after the modification processing, y is the adjusted amplitude value, which is greater than 0, in the adjusted amplitude values of the sample values, and b is a constant for which $0<b<2$.

14. An apparatus for reconstructing a noise component of a speech/audio signal, the apparatus comprising comprising:

a receiver configured to receive a bitstream;

at least one processor configured, upon execution of instructions, to perform the following steps:

decode the bitstream to obtain a speech/audio signal;

determine a first speech/audio signal according to the speech/audio signal, wherein the first speech/audio signal is a signal having a noise component to be reconstructed;

determine a symbol of each sample value in the first speech/audio signal and an amplitude value of each sample value in the first speech/audio signal;

determine an adaptive normalization length;

determine an adjusted amplitude value of each sample value according to the adaptive normalization length and the amplitude value of each sample value; and reconstruct the noise component of the first speech/audio signal by determining a second speech/audio signal according to the symbol of each sample value and the adjusted amplitude value of each sample value;

wherein the at least one processor is further configured to:

calculate, according to the amplitude value of each sample value and the adaptive normalization length, an average amplitude value corresponding to each sample value, and determine, according to the average amplitude value corresponding to each sample value, an amplitude disturbance value corresponding to each sample value; wherein, the average amplitude value corresponding to each sample value is the average amplitude value of the sum of values of all sample values in the subband to which the sample value belongs relative to the adaptive normalization length; and calculate the adjusted amplitude value of each sample value according to the amplitude value of each sample value and according to the amplitude disturbance value corresponding to each sample value.

15. The apparatus according to claim 14, wherein the at least one processor is further configured to:

determine, for each sample value and according to the adaptive normalization length, a subband to which the sample value belongs; and calculate an average value of amplitude values of all sample values in the subband to which the sample value belongs, and use the average value obtained by means of calculation as the average amplitude value corresponding to the sample value.

16. The apparatus according to claim 15, wherein the at least one processor is further configured to:

perform subband grouping on all sample values in a preset order according to the adaptive normalization length, and for each sample value, determine a subband comprising the sample value as the subband to which the sample value belongs.

17. The apparatus according to claim 15, wherein the at least one processor is further configured to:

for each sample value, determine a subband consisting of m sample values before the sample value, the sample value, and n sample values after the sample value as the subband to which the sample value belongs, wherein m and n depend on the adaptive normalization length, m is an integer not less than 0, and n is an integer not less than 0.

18. The apparatus according to claim 14, wherein the at least one processor is further configured to:

subtract the amplitude disturbance value corresponding to each sample value from the amplitude value of each sample value, to obtain a difference between the amplitude value of each sample value and the amplitude disturbance value corresponding to each sample value, and use the obtained difference as the adjusted amplitude value of each sample value.

19. The apparatus according to claim 14, wherein the at least one processor is further configured to:

divide a low frequency band signal in the speech/audio signal into N subbands, wherein N is a natural number;

calculate a peak-to-average ratio of each subband, and determine a quantity of subbands whose peak-to-average ratios are greater than a preset peak-to-average ratio threshold; and calculate the adaptive normalization length according to a signal type of a high frequency band signal in the speech/audio signal and the quantity of the subbands.

20. The apparatus according to claim 19, wherein the at least one processor is further configured to:

calculate the adaptive normalization length according to a formula $L=K+\alpha\times M$, wherein L is the adaptive normalization length; K is a numerical value corresponding to the signal type of the high frequency band signal in the speech/audio signal, and different signal types of high frequency band signals correspond to different numerical values K; M is the quantity of the subbands whose peak-to-average ratios are greater than the preset peak-to-average ratio threshold; and a is a constant less than 1.

21. The apparatus according to claim 14, wherein the at least one processor is further configured to:

calculate a peak-to-average ratio of a low frequency band signal in the speech/audio signal and a peak-to-average ratio of a high frequency band signal in the speech/audio signal; and when an absolute value of a difference between the peak-to-average ratio of the low frequency band signal and the peak-to-average ratio of the high frequency band signal is less than a preset difference threshold, determine the adaptive normalization length as a preset first length value, or when an absolute value of a difference between the peak-to-average ratio of the low frequency band signal and the peak-to-average ratio of the high frequency band signal is not less than a preset difference threshold, determine the adaptive normalization length as a preset second length value, wherein the first length value is greater than the second length value.

22. The apparatus according to claim 14, wherein the at least one processor is further configured to:

calculate a peak-to-average ratio of a low frequency band signal in the speech/audio signal and a peak-to-average ratio of a high frequency band signal in the speech/audio signal; and when the peak-to-average ratio of the low frequency band signal is less than the peak-to-average ratio of the high frequency band signal, determine the adaptive normalization length as a preset first length value, and when the peak-to-average ratio of the low frequency band signal is not less than the peak-to-average ratio of the high frequency band signal, determine the adaptive normalization length as a preset second length value.

23. The apparatus according to claim 14, wherein the at least one processor is further configured to:

determine the adaptive normalization length according to a signal type of a high frequency band signal in the speech/audio signal, wherein different signal types of high frequency band signals correspond to different adaptive normalization lengths.

24. The apparatus according to claim 14, wherein the at least one processor is further configured to:

determine a new value of each sample value according to the symbol and the adjusted amplitude value of each sample value, to obtain the second speech/audio signal.

25. The apparatus according to claim 24, wherein the at least one processor is further configured to:

Perform, when the adjusted amplitude value is greater than 0, modification processing on the adjusted amplitude values of the sample values by using the following formula:

$$Y=y\times(b-\beta);$$

wherein Y is the adjusted amplitude value obtained after the modification processing; y is the adjusted amplitude value, which is greater than 0, in the adjusted amplitude values of the sample values; and b is a constant, and $0<b<2$.

26. The apparatus according to claim 14, wherein the at least one processor is further configured to:

calculate a modification factor, and perform modification processing on an adjusted amplitude value greater than 0 according to the modification factor, and determine a new value of each sample value according to the symbol of each sample value and an adjusted amplitude value obtained after the modification processing to obtain the second speech/audio signal.

27. The apparatus according to claim 26, wherein the at least one processor is further configured to calculate the modification factor by using a formula $\beta=a/L$, wherein $\beta$ is the modification factor, L is the adaptive normalization length, and a is a constant greater than 1.

* * * * *